US006898802B1

(12) United States Patent
Suarkeo

(10) Patent No.: US 6,898,802 B1
(45) Date of Patent: May 31, 2005

(54) PLIABLE SHOCK-ABSORBING SLIP ON GRIP-GLOVES

(75) Inventor: Mark Anthony Suarkeo, Simi Valley, CA (US)

(73) Assignee: Mark A. Suarkeo, Simi Valley, CA (US)

( * ) Notice: Subject to any disclaimer, the term of this patent is extended or adjusted under 35 U.S.C. 154(b) by 0 days.

(21) Appl. No.: 10/866,543

(22) Filed: Jun. 12, 2004

(51) Int. Cl.[7] ..... A41D 13/08
(52) U.S. Cl. ..... 2/20
(58) Field of Search ..... 2/16, 18, 19, 20, 2/21, 159, 161.2, 161.8, 167, 169

(56) References Cited

U.S. PATENT DOCUMENTS

| | | | | | |
|---|---|---|---|---|---|
| 456,230 | A | * | 7/1891 | Wilson | 2/20 |
| 690,302 | A | * | 12/1901 | Lee | 2/20 |
| 950,633 | A | * | 3/1910 | Eastman | 2/20 |
| 1,465,223 | A | * | 8/1923 | Kobbe | 2/20 |
| 2,077,202 | A | * | 4/1937 | Barrie | 2/20 |
| 2,244,445 | A | * | 6/1941 | Carson et al. | 2/20 |
| 2,547,388 | A | | 4/1951 | Griffin | |
| 2,738,190 | A | * | 3/1956 | Tureaud | 2/20 |
| 3,890,648 | A | * | 6/1975 | Beal | 2/20 |
| 3,896,498 | A | | 7/1975 | Pang | |
| 4,291,077 | A | * | 9/1981 | Mundell | 2/20 |
| 4,487,412 | A | | 12/1984 | Meeko | |
| 4,617,684 | A | * | 10/1986 | Green et al. | 2/20 |
| 4,754,499 | A | | 7/1988 | Pirie | |
| 5,173,963 | A | * | 12/1992 | Greenberg | 2/20 |
| 5,479,660 | A | * | 1/1996 | Najac | 2/20 |
| 5,603,679 | A | * | 2/1997 | Reis | 2/20 |
| 5,620,399 | A | | 4/1997 | Hofmann | |
| 5,652,955 | A | * | 8/1997 | Skewis | 2/20 |
| 5,888,180 | A | | 3/1999 | Dewberry | |
| 6,146,319 | A | | 11/2000 | Tarail | |
| 6,532,594 | B1 | * | 3/2003 | Barnett | 2/20 |

* cited by examiner

*Primary Examiner*—Danny Worrell

(57) ABSTRACT

A significantly improved hand protecting device used for grasping objects requiring grip force, particularly a weight-lifting bar or barbell. This slip on grip-gloves (10, 12) include a specially configured sheet (14A, 14B) featuring a thumb protrusion (22) whereby protecting the medical portion of the thumb while an object is being gripped, wherein the sheet (14A, 14B) having pliable, conformable, and shock absorbing characteristics whereby providing the user with enhanced comfort and protection against the entire palm side of the user's hand (24). An elastic securing strap (18) attached to opposing left and right attachment ends (20L, 20R) of the sheet (14A, 14B) ensures suspension and proper fitting as the user's fingers are slipped between the sheet (14A, 14B) and securing strap (18) with extreme simplicity.

5 Claims, 4 Drawing Sheets

PLIABLE SHOCK-ABSORBING SLIP ON GRIP-GLOVES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to grips and gloves, specifically used when weightlifting, with significant improvement in comfort, protection, hygiene, and extreme ease of donning and doffing.

BACKGROUND OF THE INVENTION—DISCUSSION OF PRIOR ART

The earliest gloves were most probably worn solely for protection and warmth. Modem gloves are made of fabric, plain or knitted; of leather from almost every variety of animal hide; and of rubber and plastic used in surgical, laboratory and household work.

Weightlifting gloves were developed in order to help reduce the unavoidable callus, which is a localized, firm thickening of the upper layer of skin. This results from repetitive friction between the weightlifting bar or barbell and the person's palm.

There are countless types of weightlifting gloves and grips on the market that attempt to protect the palm side of the hand while the user holds a forceful grip around a weightlifting bar. The majority of these gloves are made out of leather, which can create numerous problems.

Most weightlifting gloves enclose the entire hand and wrist with the exception of cut outs around the level of the proximal phalanx of each digit, or finger. This exposes the thumb as well as the middle and distal phalanges of the fingers. This concept was developed in an effort to prevent undesired perspiration of the hands by allowing air to circulate through. This problem is not eradicated. Also, the enclosure of material over the entire metacarpus, or hand, can be constricting and unattractive to certain individuals.

Another complication that occurs with the cut out concept is that the fingerstalls tend to bunch up or wrinkle as the weightlifter is forcefully gripping a weightlifting bar. This results in callus formation specifically at the metacarpaphalangeal and interphalangeal joints on the palm side. Calluses are very uncomfortable, unappealing and unhealthy. They can potentially result in skin breakdowns and infections, which can ultimately lead to other serious medical conditions.

Moreover, such calluses on the hand will have limiting effects on the length of time a weightlifter can maintain a forceful grip on a weightlifting bar. Likewise, they can also limit the overall amount of time a person exercises due to the pain and discomfort associated with calluses. This effect may ultimately limit the weightlifter's desired and potential strength, endurance, and muscle growth.

Most weightlifting gloves utilize straps and Velcro tabs to help secure the glove from coming off the weightlifter's hand. The use of fingerstalls also helps to maintain the positioning of the glove in the correct anatomical placement to ensure proper fitting. These characteristics present difficulty in donning and doffing because each finger requires accurate placement through each receiving fingerstall. In addition, Velcro tabs require excess effort, skill, and coordination in attaching and securing the glove to the weightlifter's hand. Furthermore, straps and wrist supports restrict the necessary range of motion of the wrist while working out.

There are several types of weightlifting or exercise gloves and grips in the prior art that attempt to protect the hand from callus formation. Other purposes are for providing comfort and a secure grasp of a weightlifting bar. The conventional devices in the market include gloves, straps, and rigid hooks that fasten over a weightlifting bar. There are several disadvantages of each that do not solve such problems.

Prior art inventors have failed in such problems discussed above because of improper use of materials, excessive use of materials or lack of conception.

The weight lifting support and cushion device in U.S. Pat. No. 5,888,180 (Dewberry, 1999) utilizes a plurality of straps that make donning and doffing exceedingly complex.

U.S. Pat. No. 5,620,399 (Hoffman, 1997) discloses a gripping sleeve for tightly gripping an object by hand. The gripping sleeve is attached by means of a wristband connected by a web. Such straps may cause constriction and discomfort around the wrist while a tensile stress is applied during lifting or pulling of a weightlifting bar. Such constriction can obstruct blood circulation temporarily. In addition, two Velcro tabs that require attachment at the wrist are utilized for securing the gripping sleeve, which makes donning and doffing complex. They also restrict full range of motion of the wrist.

U.S. Pat. No. 4,754,499 (Pirie, 1988) discloses gripper pads for hands that contain finger loops on the pad through which digits 2–5 extends for securing the gripper pad to a user's hand. Such loops are superfluous and make donning and doffing difficult. They also restrict full range of motion of the fingers.

U.S. Pat. No. 6,146,319 (Tarail, 2000) discloses an exercise grip and method that utilize two straps that wrap around a weightlifter's wrist. Such straps may cause constriction and discomfort around the wrist while a tensile stress is applied. Such constriction can obstruct blood circulation temporarily. In addition, the two straps make donning and doffing unnecessarily complex. They also restrict fill range of motion of the wrist.

The glove apparatus in U.S. Pat. No. 2,547,388 (Griffin, 1951) enclose the entire metacarpus on the palm and dorsal portion of the hand, which limits thorough air circulation. This can lead to heat buildup and excessive perspiration. Two straps require manual attachment, which makes donning and doffing complex. This device includes four loops through which digits 2–5 extends for securing the glove apparatus to the weightlifter's hand. This also makes donning and doffing unnecessarily complex.

U.S. Pat. No. 3,896,498 (Pang, 1975) discloses a palm guard having a palm portion adapted to fit flat against and cover a major part of the palm of the user. However, protection of the digits as well as the upper and lower portion of the palm is not protected.

The weightlifting grips in U.S. Pat. No. 4,487,412 (Meeko, 1984) utilizes an inverted U-shaped cradle that is placed over the bar of the weight equipment and the user's hand grips the outside surface of the grip. An endless belt attached to the bottom edge of the grip through a slot pass behind the user's wrist to provide reinforcement and increase the hand and finger's grip. Such straps may cause constriction and discomfort around the wrist while a tensile stress is applied during lifting or pulling of a weightlifting bar. Such constriction can obstruct blood circulation temporarily. In addition, the strap makes donning and doffing unnecessarily complex. It also restricts full range of motion of the wrist.

To conclude, the prior art offers a variety of weightlifting gloves, straps and other devices that serve to protect the hands while maintaining a tight grip onto a weightlifting bar or barbell.

The disadvantages of the prior art include confinement around the entire metacarpus, constriction of arterial and venous blood flow about the wrist, and increased amounts of undesired heat, which may lead to sweating. In turn, sweating can lead to the effects of a glove drying up and losing its pliability causing ridges to form within the glove. This can ultimately lead to callus formation due to repetitive skin irritation. For this reason, the weightlifter does not benefit from the ability to lift weights with more repetitions and/or heavier weight due to the pain and discomfort associated with calluses.

Also, the use of fingerstalls requires increased effort, time, and coordination in donning and doffing as do Velcro tabs and other straps that help suspend such devices. Likewise, finger loops restrict full range of motion of the fingers. The exposed fingers are not protected on the palm side of the hand. This can potentially increase the risk of contracting germs or bacteria from a weightlifting bar through indirect contact transmission. The excessive material around the wrist such as wrist supports, Velcro tabs, and suspension straps restrict the necessary full range of motion of the wrist.

Weightlifting straps do not provide the necessary protection around the entire palm. Straps may cause constriction and discomfort around the wrist while a tensile stress is applied during lifting or pulling of a weightlifting bar. Such constriction can obstruct blood circulation temporarily. In addition, such straps make donning and doffing unnecessarily complex. They also restrict full range of motion of the wrist.

Certain gloves and rigid devices are not pliable, which prohibits the user from gaining a complete grip on the weightlifting bar. As a result, the user minimizes full control, proprioception and tactility of the weightlifting bar.

BACKGROUND OF THE INVENTION—OBJECTS AND ADVANTAGES

Accordingly, several objects and advantages of my invention over the prior art include significantly enhanced comfort, improved hygiene, improved air circulation, increased durability, protection of the entire palm side of the user's hand, and its characteristic property of taking shape of a weightlifting bar or barbell.

Sweating of the hand is limited due to the non-encapsulating feature of the slip on grip-glove, which exposes the majority of the metacarpals and fingers on the dorsal side of the hand. Therefore, air circulation is improved. Another advantage of this apparatus is that it does not require excessive material such as a wrist strap or any other strap around the wrist to provide suspension. This allows the weightlifter to obtain the necessary full range of motion of the wrist while lifting weights without compromising blood circulation.

Similarly, my device does not require fingerstalls to ensure proper fitting. The single elastic strap wrapped around the dorsal side of the user's hand provides sufficient suspension allowing the user's fingers to obtain full range of motion.

My device's material is pliable and conformable, which essentially eliminates bunching or wrinkling of the slip on grip-glove. As a result, shear stress and skin irritation is limited and thus helps to protect the skin from callus formation on the palm. Furthermore, the weightlifter may benefit from the ability to lift weights with more repetitions and/or heavier weight due to the lack of pain and discomfort that would result if calluses were present Thus, the weightlifter will have a greater chance of maximizing their full potential in muscle strength, endurance, and growth.

Other objects and advantages relate to the surface material of the pliable shock-absorbing slip on grip-gloves. The surface that lies against the palm is made up of a smooth coating providing enhanced comfort, which decreases friction or shear stress between the palm and the grip-glove. Conversely, the surface that lies or wraps around the item being grasped is made up of a roughened composition. This provides the necessary friction required to maintain a tight grip on the item being grasped in order to help prevent slippage.

Another object of my slip on grip-gloves is that it offers adequate protection on the palm surface of the user's hand. The slip on grip-gloves provides sufficient material that extends from the base of the palm to the distal phalanges of the fingers. This significantly reduces the amount of contact between the hand and the weightlifting bar. This may reduce the risk of contracting germs or bacteria via indirect transmission from contact with the item being grasped. Normally, this is a major health concern within fitness clubs. This is due to the fact that gym members share exercise equipment, which increases the risk of a person contracting illness.

Yet another object of my slip on grip-gloves includes extreme simplicity in donning and doffing. The single elastic strap around the back of the hand allows the user to don and doff the grip-glove in one single motion rather than having to place each finger through a fingerstall. It also eliminates the use of straps around the wrist, which allows the user full range of motion of the wrist.

Further objects and advantages of my invention will become apparent from a consideration of the drawings and ensuing description.

SUMMARY

This device is a significantly enhanced hand-protecting apparatus with shock absorbing characteristics and extreme pliability enabling it to take shape of an object being grasped. Designed to protect the palm side of a user's hand, featuring a thumb protrusion for protecting the thumb, is non-encapsulating feature benefits the user in maintaining a forceful and comfortable grip allowing full range of motion of the wrist while reducing the amount of skin irritation and heat build up.

DRAWINGS FIGURES

PREFERRED EMBODIMENT

Figure 1:
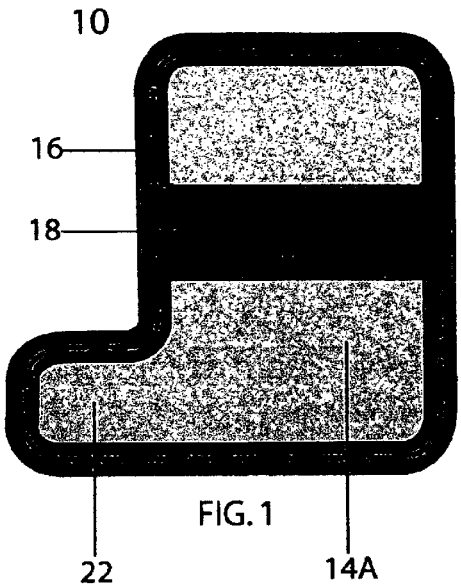
FIG. 1 is a top view of a right pliable hand-cushioned slip on grip-glove of the present invention.
Figure 2:
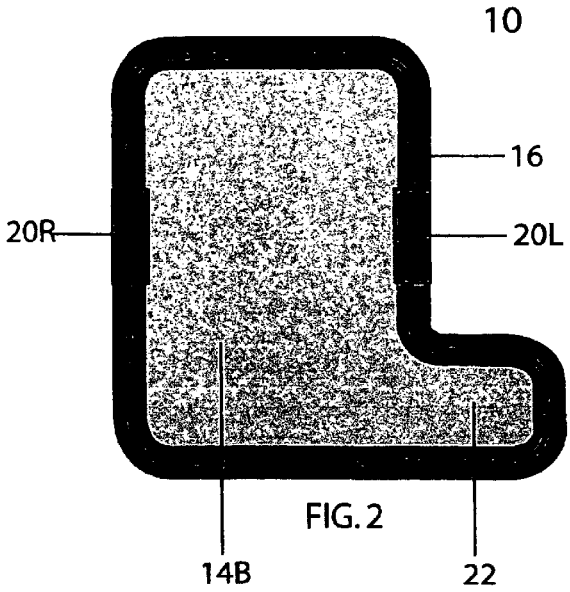
FIG. 2 is a bottom view of FIG. 1.
Figure 3:
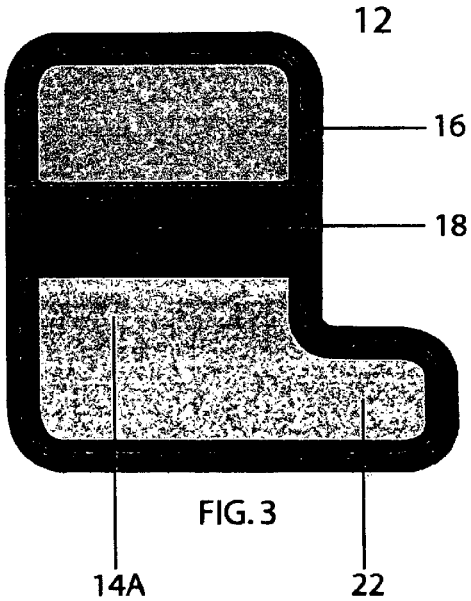
FIG. 3 is a top view of a left pliable hand-cushioned slip on grip-glove of the present invention.
Figure 4:
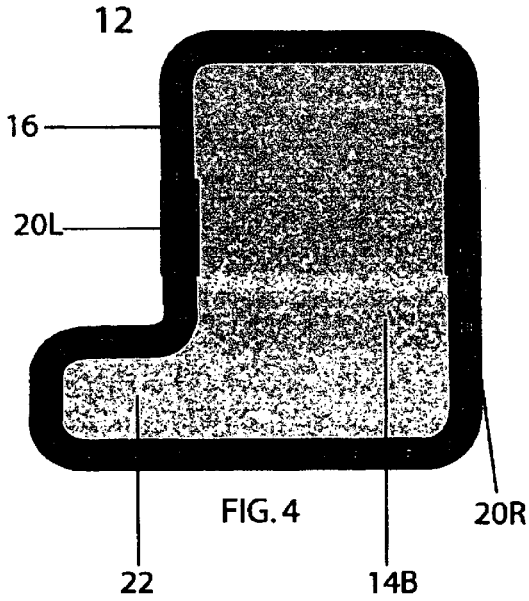
FIG. 4 is a bottom view of FIG. 3.

FIG. 1 shows a top view of a right pliable hand-cushioned grip-glove 10 and FIG. 2 shows a bottom view of the right grip-glove 10 of the preferred embodiment. FIG. 3 shows a top view of a left pliable hand-cushioned grip-glove 12 and FIG. 4 shows a bottom view of the left grip-glove 12.

The grip gloves 10, 12 each consist of topside of sheet 14A and underside of sheet 14B made of polypropylene terephthalate wherein the topside of sheet 14A consists of a smooth coating. This gives the user enhanced comfort and less shear stress or friction against the palm of a user's hand. Conversely, the opposing underside of sheet 14B consists of a roughened texture allowing for enhanced friction on an item being grasped whereby helping to prevent slippage.

The entire border of the grip-gloves 10, 12 are covered by reinforcing material 16 preferably made of elastic to help maintain resiliency and structure of the grip-gloves 10, 12. The reinforcing material 16 is preferably folded in half and sewn along the topside of sheet 14A and underside of sheet 14B along the entire border of the grip-gloves 10, 12.

The grip-gloves 10, 12 each contain a securing strap 18 preferably made of elastic with each end sewn to opposing ends 20L, 20R. They are covered with reinforcing material 16 whereby strengthening the bond between the securing strap 18 and attachment ends 20L, 20R.

Each grip-glove 10, 12 contain a thumb protrusion 22 located at the bottom left corner and bottom right corner, respectively when viewing FIG. 1 and FIG. 3.

Figure 5:
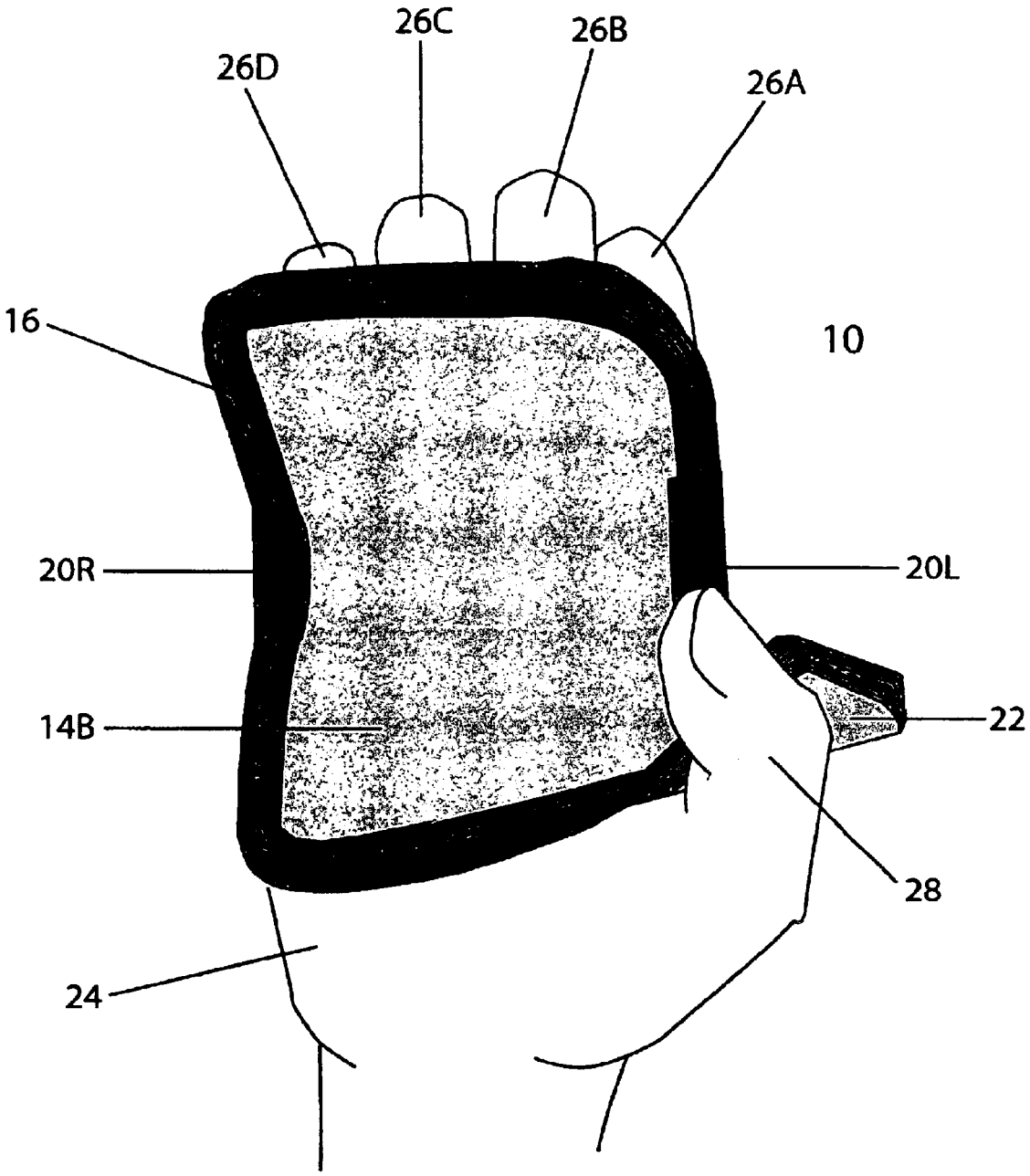
FIG. 5 is a perspective view of a right slip on grip-glove wherein the device is shown being worn on the right hand of a user.

FIG. 5 depicts a perspective view of the grip-glove 10 worn on the right hand of user 24 in which the palm side of the user's hand 24 and fingers 26A, 26B, 26C, 26D and user's thumb 28 lie against. Attachment ends 20L, 20R are the locations where the securing strap 18 (FIG. 7) connect. The user's fingers 26A, 26B, 26C, 26D and user's thumb 28 are slightly flexed revealing the pliability of the device. The resiliency of the grip-glove 10 reveals the thumb protrusion 22 allowing protection around the area of the user's index finger 26A and user's thumb 28.

Figure 6:
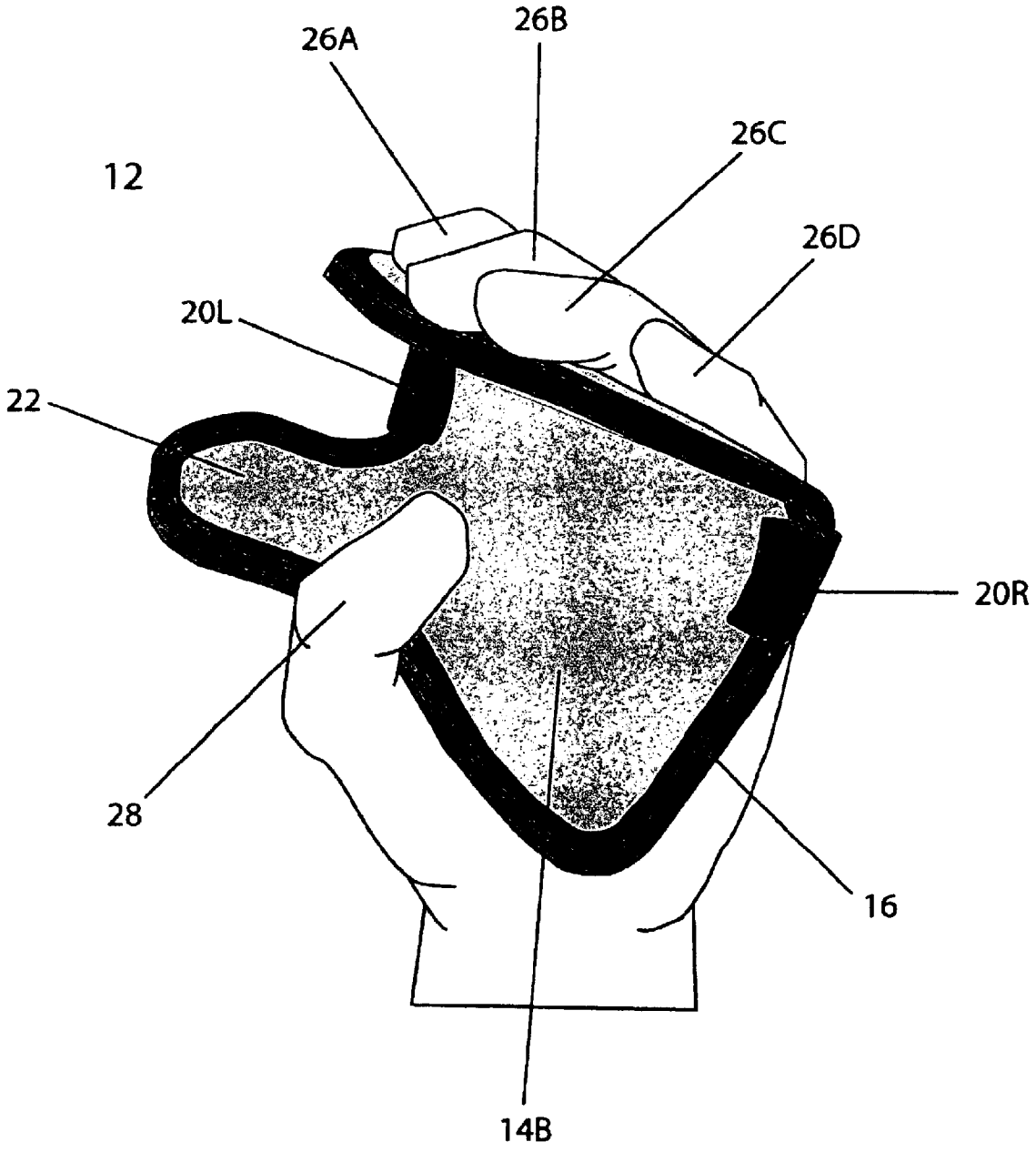
FIG. 6 is a perspective view of a left slip on gripglove wherein the device is shown being worn on the left hand of a user.

FIG. 6 reveals the same for a left grip-glove 12 on the left hand of user 24. The length and width of the grip-gloves 10, 12 will vary according to the size of the hand of user 24. In the preferred embodiment, the thickness of the sheet 14A, 14B is ¼" yet can also vary.

Figure 7:
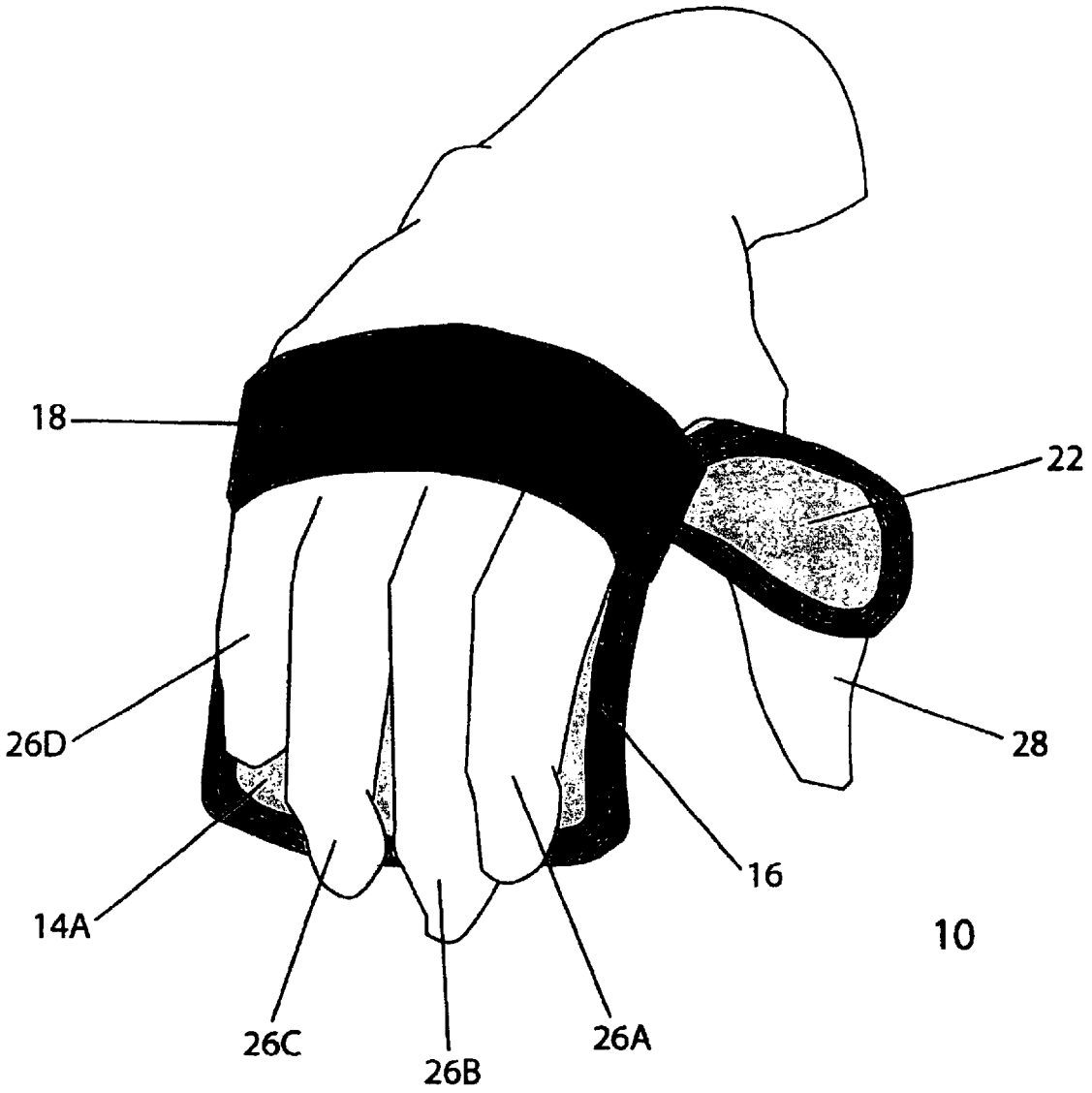
FIG. 7 is a perspective view of FIG. 5.

FIG. 7 depicts a perspective view of the grip-glove 10 worn on the right hand of user 24. The hand of the user 24 is inserted on the underside of securing strap 18 and on top of topside of sheet 14A wherein being sandwiched between the two whereby providing suspension. The securing strap 18 is wrapped with sufficient tension around the dorsal side of the right hand of user 24 whereby aiding in suspension. The user's fingers 26A, 26B, 26C, 26D and user's thumb 28 are slightly flexed revealing the pliability of the device. The extreme resiliency of the grip-glove 10 reveals the thumb protrusion 22 allowing protection around the area of the user's index finger 26A and user's thumb 28.

Operation—FIGS. 1–7

The manner of using the Pliable Hand-Cushioned Slip On Grip-Gloves 10, 12 is extremely simple and advantageous over the existing prior arts.

To don, the user simply slips fingers 26A, 26B, 26C, 26D between the elastic securing strap 18 and the smoothed surface topside of the sheet 14A. This leaves the user's hand to be sandwiched between the securing strap 18 and the topside of the sheet 14A. The user's thumb 28 is left out and is lined up with the thumb protrusion 22 for additional protection and comfort in the general area of the thumb 28 and index finger 26A. When the user grips a weightlifting bar, the slip on grig-gloves 10, 12 takes shape of the bar enabling the user to have a complete grasp while obtaining a comfortable grip. The thumb protrusion 22 folds over the bar and acts to protect and provide comfort along the medial portion of the user's thumb. The roughened surface underside of the sheet 14B makes contact with the weightlifting bar providing a sound grip.

The elastic securing strap 18 has sufficient tension against the dorsal side of the user's hand 24 around the level of the metacarpals maintaining suspension and proper placement of the slip on grip gloves 10, 12.

To doff, the user simply slips out fingers 26A, 26B, 26C, and 26D.

From the description above, a number of advantages of my pliable shock-absorbing slip on grip-gloves become evident.

The material of the slip on grip-gloves gives the user enhanced comfort due to its shock absorbing and pliable characteristics allowing the user to maintain a comfortable grip for a longer period of time.

The non-encapsulating feature of the slip on grip-gloves offers improved hygiene of the user's hand by allowing improved air circulation and minimizing heat build up, which would decrease the chance of sweating. In addition, since callus formation is unlikely, the skin is better protected from pain, discomfort, breakdown and infection. This enables the weightlifter to benefit from the ability to lift weights with more repetitions and/or heavier weight. This is possible because of the lack of pain and discomfort that would result if calluses were present. Thus, the weightlifter will have a greater chance of maximizing their full potential in muscle strength, endurance, and growth.

The use of an elastic strap across the dorsal side of the user's hand provides sufficient suspension. This device does not require straps that wrap around the wrist, which enables the weightlifter to obtain the necessary full range of motion of the wrist In addition, blood circulation is not restricted around the wrist.

My device's material is pliable and conformable, which essentially eliminates bunching or wrinkling of the slip on grip-glove. As a result, skin irritation is decreased significantly and is better protected from callus formation on the hand. Furthermore, the weightlifter may benefit from the ability to lift weights with more repetitions and/or heavier weight due to the lack of pain and discomfort that would result if calluses were present. Thus, the weightlifter will have a greater chance of maximizing their full potential in muscle strength, endurance and growth.

The sheet of the slip on grip-gloves offers opposing surfaces that benefit the user. The smoothed topside helps reduce friction or shear stress against the user's hand and the grip-glove whereby minimizing skin irritation and callus formation. Conversely, the roughened, textured underside helps increase friction against the weightlifting bar and grip-glove thereby maximizing a tight and forceful grip whereby minimizing slippage and hence, the risk of the user dropping a weightlifting bar and injuring oneself.

Another object of this device is the inclusion of a thumb protrusion for each left and right slip on grip-glove. When the gloves are properly worn and a weightlifting bar is gripped the thumb protrusion takes shape of the weightlifting bar. The thumb protrusion folds over the bar and acts to protect and provide comfort along the medial portion of the user's thumb. This is possible due to the pliable characteristics of this device.

The sheet of the slip on grip-gloves extends from the base of the palm to the distal phalanges of the fingers. Therefore, the entire palm side of the hand does not contact the item being grasped. This may reduce the risk of contracting germs or bacteria via indirect transmission from contact with the item being grasped.

The use of the single elastic strap across the dorsal side of the user's hand allows the user's fingers to move more freely. Thus, the user may benefit from enhanced tactility. In addition, the single elastic strap facilitates donning and doffing.

What is claimed is:

1. Pliable hand gripping and protecting device used for reducing stress against the palm side of a user's hand, fingers, and thumb while simultaneously grasping objects and exerting forces, comprising, in combination:

a substantially flat, generally boot shaped elastic sheet featuring a resilient thumb protrusion extending outwardly from base of said sheet as a means for protecting medial portion of thumb as said thumb protrusion takes form of an object as said user grips said object, said sheet having pliable and shock absorbing characteristics as a means for conforming to said object and providing protection of said user's hand and fingers, as said user grips said object, said sheet extending from the base of the hand to the distal phalanges to accommodate use by a human being whereby providing a pliable and comfortable grip on an object being grasped;

single securing strap having a length predetermined according to said user's hand size, located just distal to the crotch of the thumb and is attached at each left and right side attachment ends of said sheet whereby wrapping dorsal side of said user's hand with sufficient tension whereby suspending said sheet to said user's hand.

2. The device of claim 1 wherein said single securing strap is a means for providing suspension through which digits 2–5 extends through without having any partitions separating any digits.

3. The device of claim 1 wherein said sheet having a topside and underside.

4. The device of claim 1 wherein said topside of said sheet includes a first layer of material containing a smooth coating providing user with enhanced comfort and reduction of stress against the palm side of said user's hand, fingers and thumb.

5. The device of claim 1 wherein said underside of said sheet includes a second layer of material containing a roughened texture providing user with enhanced friction whereby enabling user to maintain a secure grip on an object being grasped.

* * * * *